US005947378A

United States Patent [19]

Rebotier

[11] Patent Number: 5,947,378

[45] Date of Patent: Sep. 7, 1999

[54] COOLING DRINKING STRAW

[76] Inventor: Thomas Rebotier, 8469 Paseo del Ocaso, La Jolla, Calif. 92037

[21] Appl. No.: 09/074,060

[22] Filed: May 7, 1998

[51] Int. Cl.[6] ..... A47G 21/18; B05B 1/24

[52] U.S. Cl. ..... 239/33; 239/24; 239/132.3; 239/132.1

[58] Field of Search ..... 239/24, 33, 128, 239/132, 132.1, 132.3, 139

[56] References Cited

U.S. PATENT DOCUMENTS

| | | | |
|---|---|---|---|
| 3,175,733 | 3/1965 | Lerner | 222/146 |
| 3,241,724 | 3/1966 | Lerner | 222/146 |
| 3,310,238 | 3/1967 | Bryant et al. | 239/132.3 |
| 4,494,600 | 1/1985 | DeLau | 222/146.6 X |
| 5,009,083 | 4/1991 | Spinos et al. | 62/400 |
| 5,031,831 | 7/1991 | Williams, III | 239/33 |
| 5,065,881 | 11/1991 | Tarng | 220/258 |
| 5,288,019 | 2/1994 | Gorochow | 239/33 |
| 5,415,002 | 5/1995 | Koenig | 62/63 |
| 5,427,315 | 6/1995 | Lipson | 239/33 |
| 5,507,156 | 4/1996 | Redmon | 62/400 |
| 5,584,434 | 12/1996 | Lipson | 239/33 |

*Primary Examiner*—Andres Kashnikow
*Assistant Examiner*—Robin O. Evans

[57] ABSTRACT

The invention consists of inserting one or several cores (71) in the central straw (51) of a drinking unit, through which the beverage (21) flows to be cooled or heated, flows the fluid to be heated or cooled. By altering the flow, the core plus tube system is equivalent to a narrower and longer tube. This allows to manufacture an efficient non-coiled central straw. The straw and core characteristic of the invention can have different shapes. The core needs not have the full length of the straw. In most embodiments the core has no thermal role, but in particular cases it can contribute to the heat or cold storage. Several cores, not necessarily joined, can be used in the same straw. Core and straw or straw only can be bent and shaped in various shapes. The drinking unit can be made of an enclosure (61) containing an active or passive (11) medium delivering cold or heat. The end-pieces of the unit (81, 91) can be made to accommodate detachable extensions such as a mouthpiece or a straw extension.

7 Claims, 4 Drawing Sheets

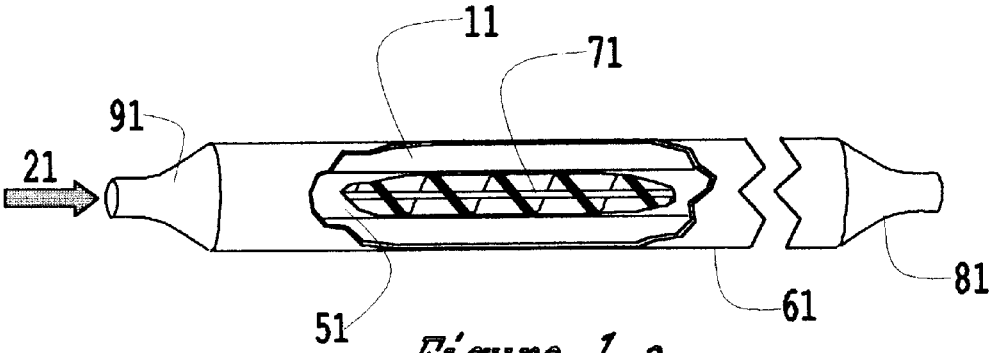
Figure 1.a
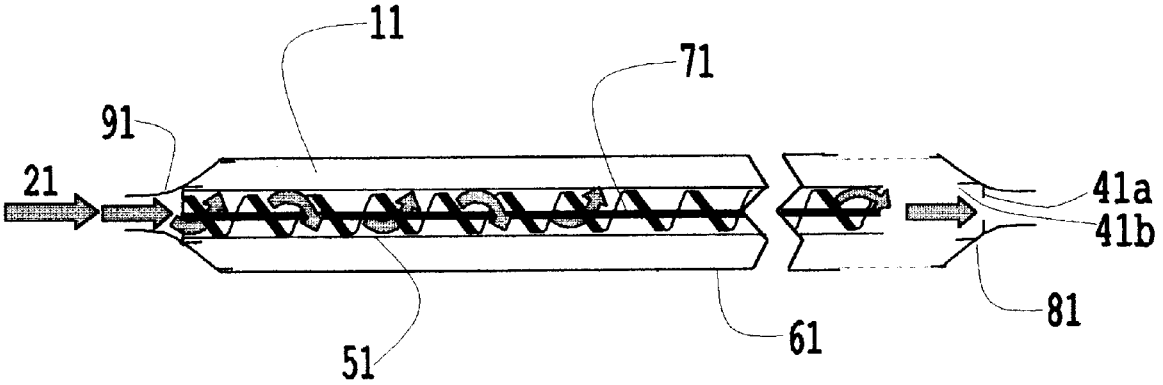
Figure 1.b
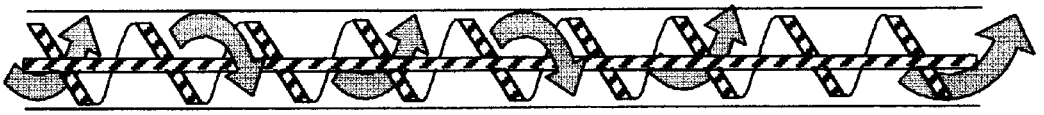
Figure 1.c

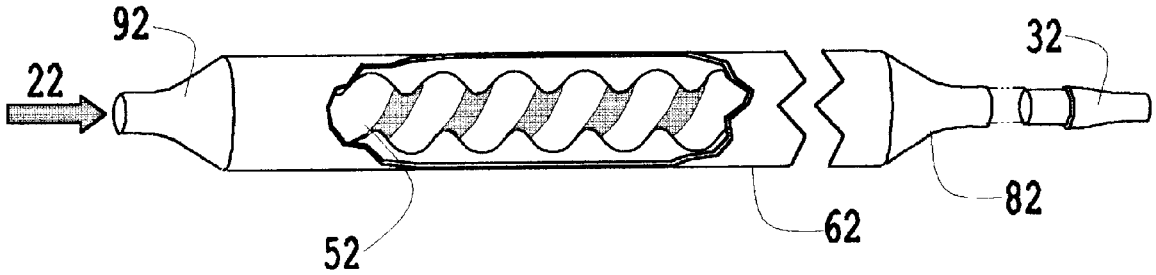
Figure 2.a
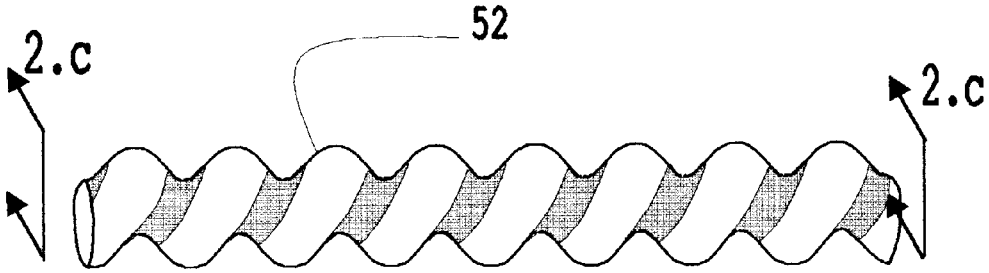
Figure 2.b
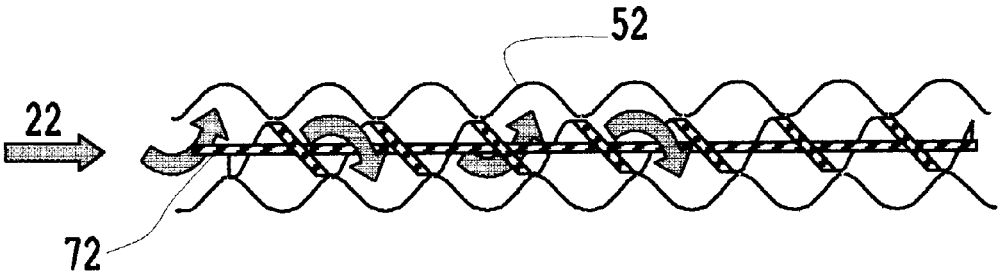
Figure 2.c

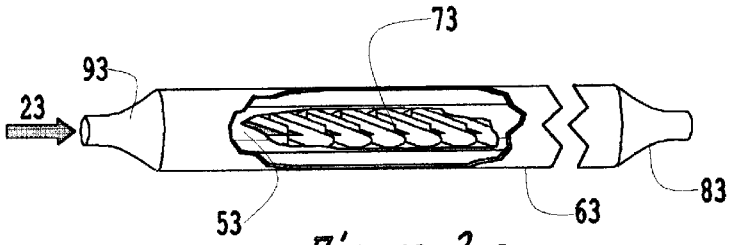
Figure 3.a
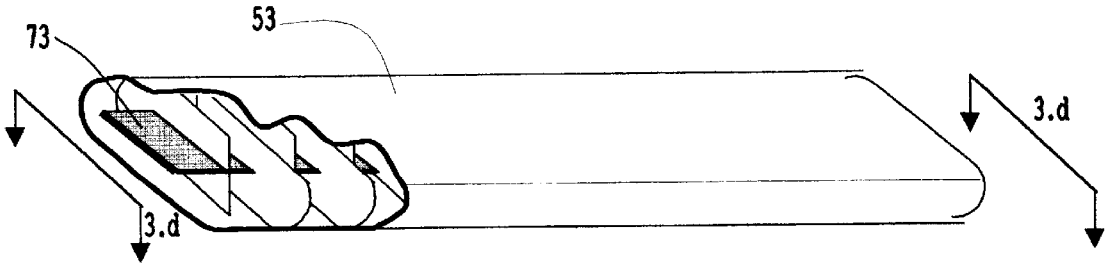
Figure 3.b
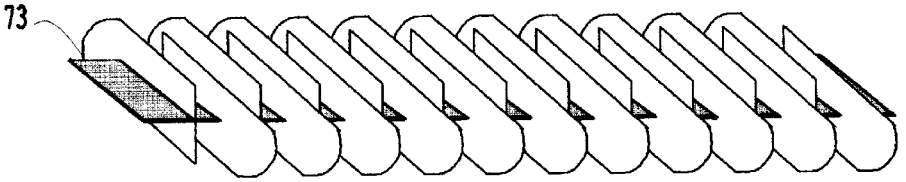
Figure 3.c
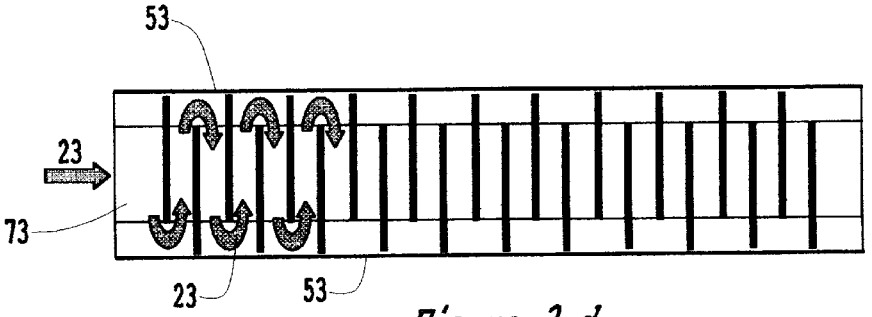
Figure 3.d

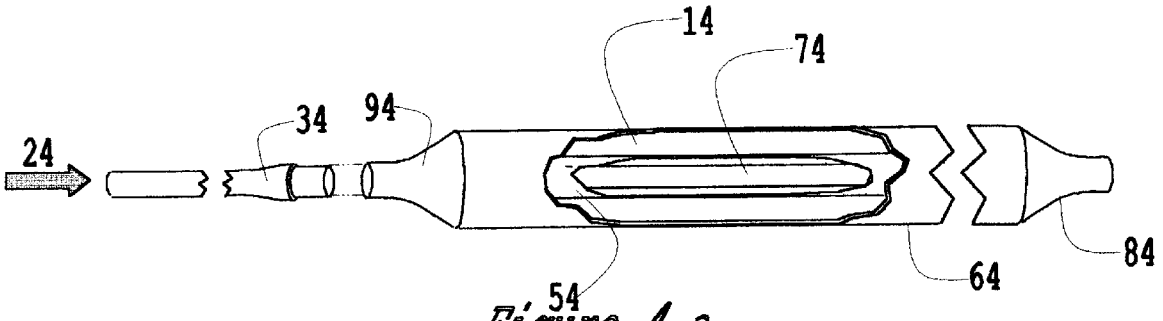
Figure 4.a
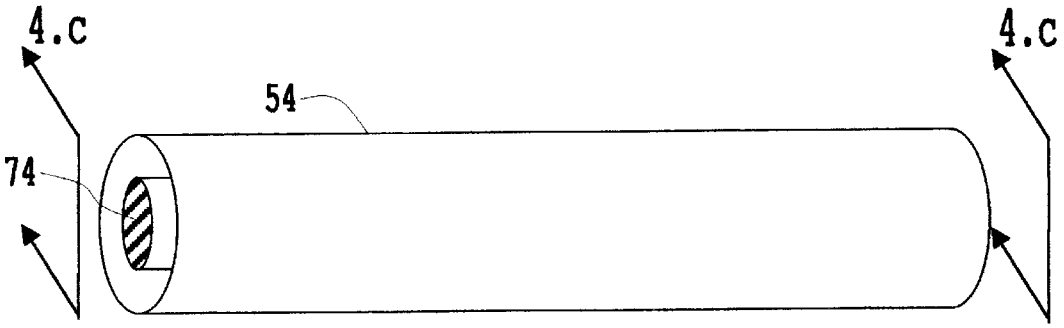
Figure 4.b
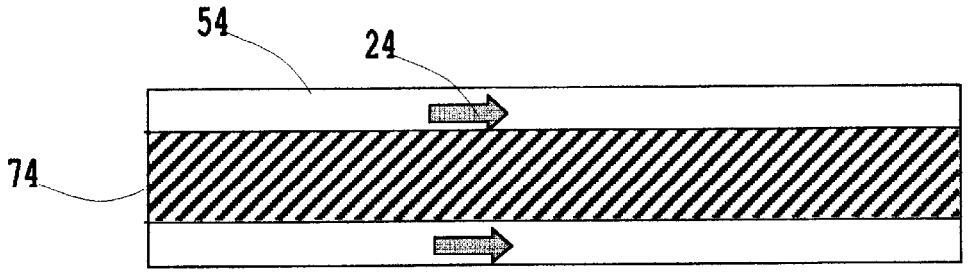
Figure 4.c

COOLING DRINKING STRAW

BACKGROUND—FIELD OF INVENTION

This invention relates to modulating temperature of liquids as they are sipped through a conduit such as a drinking straw, by utilizing a straw no longer than the unit, wherein the heat exchange capacity of the straw assembly is improved.

BACKGROUND—PRIOR ART

The problem of immediately cooling a drink when it is available lukewarm, without watering it with ice, has been addressed in different ways.

One approach to solving this problem has been to provide a container, or an addition that comes inside the container, which cools the liquid. In these designs, a tiny fraction of the cooling is also provided by having the drinking tube (usually a straw) run by or embedded in the cooling unit. However, in all these designs, the tube is straight and its total surface (the product of its length by its perimeter) is by itself insufficient to cool the liquid to a comfortable chill. Such designs include U.S. Pat. No. 5,507,156, by Redmon, "Device for cooling liquids in a sports bottle", U.S. Pat. No. 5,009,083 by Spinos, "Beverage cooler", and U.S. Pat. No. 5,065,881 by Tarng, "Tangs drinking can and cap". In addition to the afore-mentioned difference with our invention, it must be pointed out that in these three designs the straw is specified to be made of plastic, which has a bad thermal conductivity. Even if the straw were made of material with a good conductivity, a design with a straight straw of the dimensions suggested by these authors would not provide satisfactory cooling.

Another approach to this problem is to make the liquid pass through a thermal exchanger while it is sipped. Koenig, in U.S. Pat. No. 5,415,002, presents a thermal exchanger which provides satisfactory cooling. This exchanger, however, is not designed to be inserted in many beverages containers, especially a bottleneck, and uses a convoluted tube of great length. Gorochow, in U.S. Pat. No. 5,288,019, "beverage cooling sipper", presents a drinking device suited to cool hot liquids. This device suffers from the same deficiency in heat exchange capacity as the straight straws in the first three references. However, as the temperature difference between hot and cold is higher than between lukewarm and cold, heat exchange is accelerated in the case of cooling scalding liquids, thus the device is appropriate for its designated use; it would be highly insufficient in cooling lukewarm liquids to a desirably chilly temperature. Finally, Williams, III, in U.S. Pat. No. 5,031,831, "device for cooling potable liquids", discloses an invention where the liquid is cooled in a capillary tube running through refrigerant material. Williams does point out the necessity for good thermal exchange, but does not expand on the technical requirements that it demands: (column 2, lines 16–24) "The inside of the cylinder 7 houses a continuously wound up capillary tube 6 constructed with a very thin walled material in order to improve temperature transfer. The length of this inside capillary tube and the thickness of its wall would directly affect the cooling of the liquid drawn through it." In fact, in order to provide the drinker with the same flow, the critical factor is the area of heat exchange; this is why Williams designs his heat exchanger primarily as a coil. Unfortunately, this is also the Achille's heel of the invention, because the manufacture of that coil is delicate. Current commercial straws have a diameter of 6 mm (nearly ¼ inch), and according to Williams, the outside "cylinder 5 is ⅜ inches or larger" (column 2, lines 12–13). Besides the fact that William's FIG. 1 is obviously not to the proportions quoted in the disclosure, it is obvious that coiling a tube of ¼ inch diameter without crunching it will most likely result in a coil at least 1.5 inch wide. This contraption makes the outside cylinder much too wide to be used through a bottleneck. Moreover, the manufacture of this coil will be delicate, and hence expensive.

Besides cooling devices, Lipson presents two straws with inserts. In U.S. Pat. No. 5,427,315, he presents a straw with a flat insert onto which advertising can be printed. In U.S. Pat. No. 5,584,434, he presents a straw coiled around a prize object. Neither of these inserts is within the straw tube. Neither of these inserts has the function of cooling the liquid.

OBJECTS AND ADVANTAGES OF THE INVENTION

The object of the invention is to provide a cooling drinking unit where the straw itself is of the same length of the unit. The invention permits the heat exchange with a pre-cooled, frozen, or pre-heated material, to occur in a compact and efficient exchanger, narrow and less convoluted than the exchangers used in the prior art. Further objects and advantages of the invention will become apparent from a consideration of the drawings and ensuing description.

SUMMARY OF THE INVENTION

The invention proposes to insert a core within the tube through which the beverage flows. Because it includes such a core, the tube can be made of greater diameter while retaining the same efficient section of beverage circulation. The core improves the efficiency of the heat exchange either by improving the ratio of tube area to section, or by increasing the flow path without increasing the overall length, or both. In one embodiment, the core can be straight, implementing a thin film exchanger. In another embodiment the core can be helical, so that the beverage has to wind around the helix, so that the path of circulation the fluid in the tube is lengthened. In yet another embodiment, the core can be made of connected walls or baffles, alternatively obstructing one side or the other of the tube. The tube itself can be straight, with a section of any shape, or can have any shape adapted to that of the core in order to improve the area of heat transfer. This tube passes through an enclosure which can contain refrigerant or heating material of various kinds, such as pre-cooled or frozen refrigerant, pre-heated material, endothermic chemical or exothermic chemical.

LIST OF DRAWING FIGURES

FIG. 1.*a* shows one embodiment the invention using a central straw with a helical core FIG. 1.*b* shows a longitudinal section of the unit of FIG. 1.*a*

FIG. 1.*c* shows a section of the central straw of the unit of FIG. 1.*a,* with its helical core, and shows how the beverage circulates FIG. 2.*a* shows a variant of the invention where the central straw is given a helical shape complementing that of the helical core.

FIG. 2.*b* shows the central straw of the unit shown in FIG. 2.*a*

FIG. 2.*c* shows is a section through the straw of FIG. 2.*a,* showing the helical core and the circulation of the beverage around it.

FIG. 3.*a* shows a third variant of the invention, with a flattened central straw.

FIG. 3.*b* shows a perspective of the central straw of FIG. 3.*a*.

FIG. 3.*c* shows a perspective of the particular core used in the embodiment of FIG. 3.*a*

FIG. 3.*d* shows a section through the flattened central straw of FIG. 3.*a*, illustrating the circulation of the beverage around the core.

FIG. 4.*a* shows yet a different embodiment of the invention, with a plain cylindrical core.

FIG. 4.*b* shows a perspective of the central straw of FIG. 4.*a*.

FIG. 4.*c* shows a section through the central straw of

FIG. 4.*b* illustrating the circulation of the beverage.

LIST OF REFERENCE NUMERALS

FIGS. 1.*a* and 1.*b* (numbers terminate with a "1"):

11 thawing gel
21 beverage circulating through the straw
41*a* circular flat ring attached to the end piece to prevent the core from sliding out
41*b* short cylindrical ring attached to the end piece to hold the core in place in the enclosure
51 central straw
61 outer casing
71 helical core inserted in tube 51
81 end piece (beverage end or mouth piece)
91 other end piece (mouth piece or beverage end)

FIGS. 2.*a*, 2.*b* and 2.*c* (numbers terminate with a "2"):

22 beverage circulating through the straw
32 detachable mouthpiece
52 central straw of helical shape
62 outer casing
72 helical core inserted in straw 52
82 end piece into which is inserted the mouthpiece
92 other end piece FIGS. 3.*a*, 3.*b*, 3.*c* and 3.*d* (numbers terminate with a "3"):

23 beverage circulating through the straw
53 flattened central straw
63 outer casing
73 core with wings alternatively placed
83 end piece (beverage end or mouth piece)
93 other end piece (mouth piece or beverage end)

FIGS. 4.*a*, 4.*b*, and 4.*c* (numbers terminate with a "4"):

24 beverage circulating through the straw
34 removable straw extension
54 central straw
64 outer casing
74 cylindrical core inserted in straw 54
84 end piece (mouth piece)
94 other end piece into which is inserted the extension 34.

DESCRIPTION OF THE INVENTION

The invention allows the manufacture of a unit which cools (or heats) liquids sipped through it, by having a central straw run through enclosed thermal storage material and inserting within that central straw a core, or several cores, which influence the circulating beverage so as to lengthen its path of circulation or to thin the layer of beverage subject to heat exchange, both of which result in having more efficient cooling (or heating). Compared to similar units using a coiled central straw, the invention thus allows a more compact design.

The core to be inserted can be made of ceramic, plastic, or metal, or any other material deemed appropriate by a man of the art. In particular, the core itself can be or not used as a secondary means of storing cold or heat, depending on the particular embodiment.

The central straw can be made of any material deemed appropriate by a man of the art for a tube designated to heat transfer. In the preferred embodiment of the invention, this straw is made of thin aluminum, with the same thickness and coating as is currently used for aluminum drink cans.

The material used for storing cold or heat can be thawing ice, or a thawing gel, or material which can generate heat or cold once through a chemical reaction. Such materials are known to the man of the art and have their own prior art.

The outer casing of the unit, which encloses the heat storage material, can be made of any material. In the preferred embodiment of the invention, it is made of plastic, with a low heat conductance, so that the user does not feel the cold too much when holding the unit. Other material may be considered, as well as composite casings, especially in cases where the structure invented is used in a warming rather than a cooling unit.

The core can be made of any material. The material used in the preferred embodiment would be molded plastic conforming to F.D.A. regulations for plastic in contact with aliments. Other embodiments may use cores of metal, ceramic, composite cores, or cores which themselves enclose refrigerant or heating material. Cores playing a significant role in heat or cold storage are especially suggested as a variant of the embodiment presented in FIG. 4. In this case, in the preferred embodiment of that variant, the core would be made of the same material as the central straw, and would enclose the same refrigerant, thawing material or heating material as is enclosed between the outer casing and the central straw.

The shape of the core can be varied in many ways. We describe herein, as examples amongst a variety of embodiments, and without limiting the scope of the invention, three types of cores. A helical core touching the tube forces a helical fluid circulation. A winged core, also touching the tube, forces a back-and-forth circulation across the width of a flattened tube. A straight core, which does not touch the tube wall, forces the fluid to squeeze between the core and the wall. Details are given in the paragraphs below.

FIGS. 1.*a*, 1.*b* and 1.*c* illustrate the preferred embodiment for this invention. FIG. 1.*a* is an external perspective view with some windows opened in the walls, and FIG. 1.*b* is a section through the length of FIG. 1.*a*. The exterior of the unit is made of casing 61, which encloses the refrigerant 11. In this preferred embodiment, casing 61 is made of plastic, or any material that can be held without discomfort and excessive transfer of heat between the inside and the outside. Within that casing, straw 51, through which flows the beverage, contains a core 71, according to the invention. In this preferred embodiment, straw 51 is cylindrical and made of a thin wall of material with good heat conductance, for example the same thin, varnished, aluminum wall as commercial drink cans are made of; core 71 is helical and made of molded plastic, using plastic approved by the F.D.A. for contact with human aliments. In an alternate implementation, core 71 is made of stainless steel, so that by itself it provides a boost of cold to the very first sip through the straw. The end pieces 91 and 81 are identical and fulfill a triple function. First, they enclose the refrigerant, making up a sealed enclosure with casing 61. Second, they provide a mouth piece of smaller diameter than the internal tube, and also of a different material, thus avoiding the direct contact between the lips and the metal of tube 51. Third, they provide holders 41*b* and stoppers 41*a* which hold the core 71 in its place inside tube 51. FIG. 1.*c* shows a section of the central straw of the unit of FIG. 1.*a*, with its helical core, and shows how the beverage circulates around the helical core.

The refrigerant 11 may be of any kind of material susceptible to store cold, especially by a phase change, like water or "blue ice". In alternative, disposable embodiments of the straw, it can be a disposable one-time-only refrigerant such as described in U.S. Pat. No. 5,031,831, and well known to the man of the art.

The dimensions of the straw can vary according to the expected function and to the refrigerant used. One issue that the prior art neglected to address is that of the total volume of refrigerant needed to cool a whole drink from room temperature to a chill. For example, a cooling from 20 C. to 5 C. (68 F. to 41 F.) of a 330 ml drink will require the absorption of 4950 Calories, which necessitates about 62 grams of water if water/ice is used a refrigerant. A straw narrow enough to pass through a bottleneck, taking into account the thick central tube, would have to be 45 cm long to accommodate that much ice. Using blue ice, however, which has a much higher latent heat of fusion, a straw of attractive dimensions (diameter of 16 mm and length of 30 cm) can be realized.

The beverage passes through straw 51. Because the helical core 71, inserted in tube 51, touches the wall of tube 51, the flow of the beverage must follow the helix, and turns into tube 51, thereby taking a longer path.

Neglecting the thickness of the walls of the core, and assuming that turbulence mixes the fluid and homogenizes its temperature, one can compute the tube to which tube 51 with core 71 is equivalent in terms of section of circulation and of area of cooling. If the tube 51 has length L and a section of area S, and the section of the channel delimited by the core 71 and the tube 51 is of smaller area S' then the apparatus is equivalent to a tube of length L times the square root of S/S', and of section S'. Thus, tube 51 equipped with core 71 is equivalent to a narrower and longer tube which would have to be coiled or bent to fit in the casing 61. The bending operation can become impossible if the bending radius is too small, and is also more expensive. Thus, tube 51 equipped with the core 71 improves above the prior art.

FIGS. 2.*a*, 2.*b* and 2.*c* present another embodiment of the unit. In this embodiment, the central straw 52 is given a shape that is complementary to that of the inner core. In FIG. 2.*b* straw 52 is shown at smaller scale, and one can see how the shape of the wall of straw 52 is made convex to increase the section of circulation. The beverage flow is illustrated in FIG. 2.*c* by the block arrows 22. In other embodiments, such shaping of the tube could be concave, or any other shape.

FIG. 2.*a* also shows a variation in the form of a detachable mouthpiece, 32. This piece can be made of any material, and in the preferred embodiment is made of plastic. It can also be disposable, for example be made of a piece of a regular commercial straw.

FIGS. 3.*a*, 3.*b*, 3.*c* and 3.*d* present another embodiment of the invention. The central straw 53 is flattened. Core 73 is made of walls alternatively cut on one side and the other, held together by a thin central band, so that the fluid can flow back and forth across the width of the tube, as illustrated in FIG. 3.*d* by block arrows 23. Again, this design allows considerable lengthening of the actual water flow, without forcing the manufacture of a narrow tube with a sophisticated bending pattern.

FIGS. 4.*a*, 4.*b* and 4.*c* illustrate yet another embodiment of the invention. Here, core 74 is cylindrical and does not lengthen the path of fluid circulation. However, it reduces the section of the tube 54, creating a thin film along the inside of tube 54. With the core, the ratio of the area of heat transfer to the section of circulation is higher, effectively creating a thin film exchanger in spite of the thickness of the central straw. Such a tube 54 of length L and radius R including a core of radius r has the same section and same cooling area as a tube of radius $SQRT(R^2-r^2)$ and of length $L.R/SQRT(R^2-r^2)$. Thus, in terms of cooling efficiency, this unit again avoids the complex bending of a longer, narrower tube.

FIG. 4.*a* also shows a variation which can be used in many embodiments: an detachable extension 34 at the end of the unit which can be used when the straw is too wide to be inserted into the container of the beverage. This extension can, in particular, be a regular disposable commercial straw.

The embodiment presented in FIG. 4 presents an additional advantage: because the core is a solid cylinder, it can itself be used as a means of cold storage. Thus, in an alternative embodiment, a core similar to 74 could be made hollow and full of thawing gel.

It must be well understood that the embodiments presented in FIGS. 1–4 are there as illustrative examples only, and do not limit the scope of the invention. According to the invention, the core controls the fluid flow and thereby improves the cooling. It is not necessary that the core touch the wall of the tube all along, or be separated thereof all along. A helical core like core 71 could be separated from the wall of the tube by some unspecified space. Helical or other shaping of the tube, as in FIG. 2, could run counter to the helix of the inner core. Other embodiments could use cores of various shapes in tubes of various sectional shape. For example, again, a pseudo-coil could be realized with a flat tube analogous to tube 53, but with a core in flattened helical shape.

Moreover, all the variations in shape that the invention allows for the central straw, whether they are described above or whether they are not described herein, are covered by the invention as soon as they make use of one or several cores inserted in a tube through which the beverage is cooled or heated.

Also covered by the invention are units with straws where the core does not extend through the whole length of the straw but only through part of it, or where several partial cores, joined or disjoint, are inserted in the straw.

Also covered by the invention are elements where the core and the tube are not straight, but where the ensemble can be bent or curved.

Thus, while the above description contains many specificities, these should not be construed as limitations on the scope of the invention, but rather as exemplifications of some embodiments thereof. Many other variations are possible. Accordingly, the scope of the invention should be determined not by the embodiments illustrated, but by the appended claims and their legal equivalents.

OPERATION OF THE INVENTION

The invention is operated by preparing it for the heat exchange and then sipping liquid through it. In embodiments using a passive medium of storage for cold or heat, the unit must be placed at the temperature desired for the medium for a lapse of time sufficient to let it settle thermally. For example, if the unit uses thawing gel, it must be stored ahead of time in the freezer for the time it takes for the gel to freeze. This time depends on the thermal conductance of the enclosure, on the temperature of the freezer, and on other parameters, and could typically be anywhere from 20 minutes to three hours. In units using a dynamical means for generating heat or cold, such as a chemical reaction, which has its own prior art, this heat or cold generation must be started prior to sipping the beverage.

If carried for a length of time outside the freezer, for example for a picnic, the straws should be wrapped in thermal insulator. When in use, the straw absorbs enough heat to cool a whole beverage by 15 to 20 degrees Celsius. The cooling occurs as the liquid is sipped through the straw. Liquid in the straw when the user stops sipping can flow back to the cup.

At the time scale of drinking, the system "Straw+Liquid" can be considered adiabatic, and cooling the part of the liquid which falls back into the cup is not a loss of cold, since it will save equivalent cooling later. (Therefore, adding a latch at the bottom of the straw, as done in U.S. Pat. No. 5,031,831, is useless and even harmful, as it can possibly result in liquid freezing in the straw and obstructing the beverage circulation. In our invention, since the core allows efficient cooling of the beverage "on the fly", the liquid can be allowed to flow back to the cup.) In consequence, the sipping can be done continuously, or by spurts.

Conclusion, Ramifications and Scope of the Invention

In conclusion, the invention, by using a core, substantially changes in the straw the ratio of the section of circulation of the beverage to the area of heat transfer. The lower this ratio, the better the heat transfer.

In some of its embodiments the invention lengthens the path or fluid circulation, thereby ensuing better cooling. In some of its embodiments, the invention guarantees that the layer of beverage flowing inside the straw is thinner, thus implementing a thin film heat exchanger in spite of having a section of same area as a non-thin-film straw. In some embodiments, the invention can be reduced to a partial core which simply presents obstruction to the liquid flow, slowing it all along the circuit, thereby allowing better cooling.

In all embodiments, the insertion of a core, made of material which does not have to be heat-conducting, is an alternative to manufacturing complex shapes of the tube through which flows the beverage to be heated or cooled runs.

In the reusable embodiments, cold is stored in the refrigerant by storing the straw permanently in the freezer between uses.

In conclusion, this invention provides an alternative way to manufacture the heat exchanger element crucial to any cooling or heating straw: inserting a core inside the tube through the beverage is cooled or heated. The scope of the invention therefore covers any unit for a cooling or heating straw making use of a core inside the tube through which the beverage is heated or cooled.

I claim:

1. A device for modulating the temperature of a beverage as it is drawn through a conduit in heat exchange relationship with heat exchange material in an enclosure, and in which said conduit extends longitudinally through said enclosure, and said conduit is coextensive in length with said enclosure, wherein the heat exchange relationship of said beverage passing through said conduit with said heat exchange material is augmented by means of a core positioned in said conduit to improve the efficiency of heat exchange either by improving the ratio of tube area to section, or by increasing the flow path without increasing the overall length, or both.

2. A device according to claim 1 wherein said core positioned within said conduit defines a helical passage for said beverage.

3. A device according to claim 2 wherein said core is inserted into a conduit of which the walls have a helical configuration conforming to said core, to define with said core a helical passage for said beverage.

4. A device according to claim 1 wherein said core positioned within said conduit is formed with a series of spaced baffles which are staggered to define a serpentine passage for said beverage.

5. A device according to claim 4 wherein said baffled core is inserted into a flattened conduit.

6. A device according to claim 1 wherein said core is in the form of a solid rod coextensive with said conduit and having a diameter sufficient to define a thin passage for said beverage between said core and the walls of said conduit.

7. A device according to claim 6 wherein said solid core comprises a cylinder filled with heat exchange material.

* * * * *